US007819698B2

(12) United States Patent
Islam

(10) Patent No.: US 7,819,698 B2
(45) Date of Patent: Oct. 26, 2010

(54) SEALED INNER CONDUCTOR CONTACT FOR COAXIAL CABLE CONNECTOR

(75) Inventor: Nahid Islam, Westmont, IL (US)

(73) Assignee: Andrew LLC, Hickory, NC (US)

( * ) Notice: Subject to any disclaimer, the term of this patent is extended or adjusted under 35 U.S.C. 154(b) by 255 days.

(21) Appl. No.: 12/246,638

(22) Filed: Oct. 7, 2008

(65) Prior Publication Data

US 2009/0053931 A1 Feb. 26, 2009

Related U.S. Application Data

(63) Continuation-in-part of application No. 11/843,599, filed on Aug. 22, 2007, now Pat. No. 7,448,906.

(51) Int. Cl.
*H01R 9/05* (2006.01)
*H01R 9/03* (2006.01)

(52) U.S. Cl. ..... 439/607.45; 439/578; 439/584

(58) Field of Classification Search ..... 439/578, 439/579, 584, 607.41, 607.42, 607.45
See application file for complete search history.

(56) References Cited

U.S. PATENT DOCUMENTS

| | | | | |
|---|---|---|---|---|
| 3,106,599 | A | 10/1963 | Leitner et al. | |
| 3,963,320 | A * | 6/1976 | Spinner | 439/584 |
| 4,824,400 | A | 4/1989 | Spinner | |
| 5,137,470 | A | 8/1992 | Doles | |
| 5,167,533 | A * | 12/1992 | Rauwolf | 439/583 |
| 5,545,059 | A | 8/1996 | Nelson | |
| 5,722,856 | A | 3/1998 | Fuchs et al. | |
| 5,830,009 | A | 11/1998 | Tettinger | |
| 5,938,474 | A | 8/1999 | Nelson | |
| 6,109,964 | A * | 8/2000 | Kooiman | 439/583 |
| 6,133,532 | A | 10/2000 | Lundback et al. | |
| 6,148,513 | A | 11/2000 | Schiefer et al. | |
| 6,234,838 | B1 * | 5/2001 | Wong | 439/578 |
| 6,332,808 | B1 | 12/2001 | Kanda et al. | |
| 6,332,815 | B1 | 12/2001 | Bruce | |
| 6,386,915 | B1 * | 5/2002 | Nelson | 439/584 |
| 6,471,545 | B1 * | 10/2002 | Hosler, Sr. | 439/585 |

(Continued)

FOREIGN PATENT DOCUMENTS

| | | |
|---|---|---|
| EP | 0955701 | 11/1999 |

(Continued)

OTHER PUBLICATIONS

European Search Report, counterpart EPO application No. EP09012085, issued Dec. 15, 2009.

*Primary Examiner*—James Harvey
(74) *Attorney, Agent, or Firm*—Babcock IP, PLLC

(57) ABSTRACT

A coaxial cable connector inner contact with an interface end and a cable end for coupling with the inner conductor of a coaxial cable, the inner conductor having an outer diameter surface. The inner contact provided with an inner conductor interface at the interface end, an inner conductor socket open to the cable end, a first inner diameter groove in a first sidewall section of the socket, a second inner diameter groove in the first sidewall section proximate the cable end, a first spring contact, dimensioned to engage the outer diameter surface, seated in the first inner diameter groove; and a first inward projecting seal, dimensioned to seal against the outer diameter surface, seated in the second inner diameter groove.

18 Claims, 7 Drawing Sheets

U.S. PATENT DOCUMENTS

| | | | | |
|---|---|---|---|---|
| 6,692,300 | B2 | 2/2004 | Kanda et al. | |
| 6,802,739 | B2 | 10/2004 | Henningsen | |
| 6,863,565 | B1 | 3/2005 | Kogan et al. | |
| 6,893,290 | B2 | 5/2005 | Buenz et al. | |
| 6,926,555 | B2 | 8/2005 | Nelson | |
| 7,448,906 | B1 * | 11/2008 | Islam | 439/578 |
| 7,727,014 | B2 * | 6/2010 | Zhu et al. | 439/578 |
| 7,753,727 | B1 * | 7/2010 | Islam et al. | 439/583 |
| 2007/0149047 | A1 | 6/2007 | Wild et al. | |
| 2008/0009166 | A1 | 1/2008 | Raad et al. | |
| 2008/0045081 | A1 | 2/2008 | Studerus | |
| 2009/0053931 | A1 * | 2/2009 | Islam | 439/578 |

FOREIGN PATENT DOCUMENTS

| | | |
|---|---|---|
| GB | 2387280 | 10/2003 |

* cited by examiner

SEALED INNER CONDUCTOR CONTACT FOR COAXIAL CABLE CONNECTOR

CROSS REFERENCE TO RELATED APPLICATIONS

This application is a Continuation-In-Part of U.S. Utility patent application Ser. No. 11/843,599, titled "Hollow Inner Conductor Contact for Coaxial Cable Connector", filed by Nahid Islam on Aug. 22, 2007 and hereby incorporated by reference in its entirety.

BACKGROUND OF THE INVENTION

1. Field of the Invention

The invention relates to inner contacts for coaxial cable connectors. More particularly the invention relates to coaxial cable connector inner contacts with improved environmental and anti-corrosion sealing of the coaxial cable inner conductor and inner contact electrical interconnection.

2. Description of Related Art

Prior coaxial connectors typically rely upon multiple seals between the connector, cable and or interface contact points to prevent entry of moisture and or humid air. The plurality of environmental seals significantly increases the complexity of the coaxial connector manufacture and assembly.

Competition within the coaxial cable and connector industry has focused attention upon improving electrical performance as well as reducing manufacturing, materials and installation costs.

Therefore, it is an object of the invention to provide a method and apparatus that overcomes deficiencies in such prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Prior coaxial cables typically have inner and outer conductors made from copper and copper alloy. The inventor has recognized that new coaxial cable configurations and or materials such as inner conductors of aluminum and or aluminum with copper or other metallic outer coating will require improved protection of the electrical interconnection, especially when these materials are connected to the dissimilar metals commonly applied to electrical connectors. Also, these new coaxial cable configurations are generally incompatible with prior coaxial connectors due to a creep characteristic of these softer metals and the difficulty of forming a reliable electrical connection between dissimilar metals subject to galvanic corrosion and/or moisture accelerated oxidation.

The environmental seals in typical prior coaxial connectors do not protect the electrical interconnection between the inner conductor and the inner contact from any moisture which may migrate past environmental seals, is sealed within the connector during installation and/or may migrate to the electrical interconnection area along the inside of the coaxial cable. An installation error and/or failure of any one of these seals may allow moisture and/or humid air to enter the connection areas of the connector where it can pool and cause corrosion resulting in significant performance degradation of the electrical connections.

Galvanic corrosion between the aluminum inner conductor and a dissimilar metal of the inner contact, such as bronze, brass or copper, may also contribute to accelerated degradation of the electrical and mechanical interconnection. Further, moisture penetration into the inner conductor interconnection is a much greater problem with coated aluminum material, because of the increased chance for corrosion of the aluminum material and/or delamination of any outer diameter surface coating edges, such as copper plating or metallizing, exposed to atmosphere by cutting, insulation stripping or other preparation of the cable end for interconnection.

Figure 1:
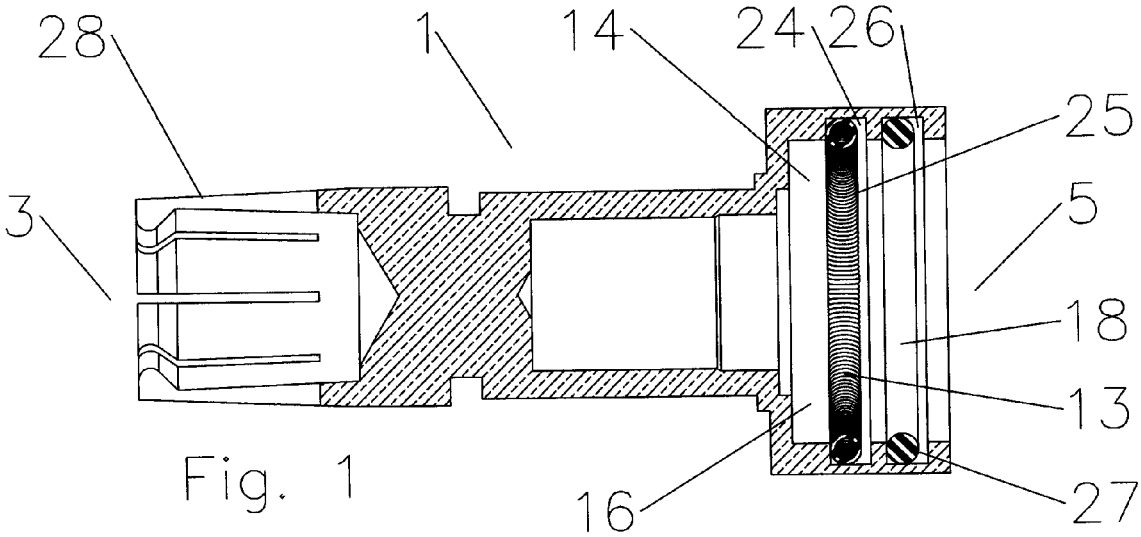
FIG. 1 is a schematic cut-away side view of a first exemplary inner conductor contact.
Figure 7:
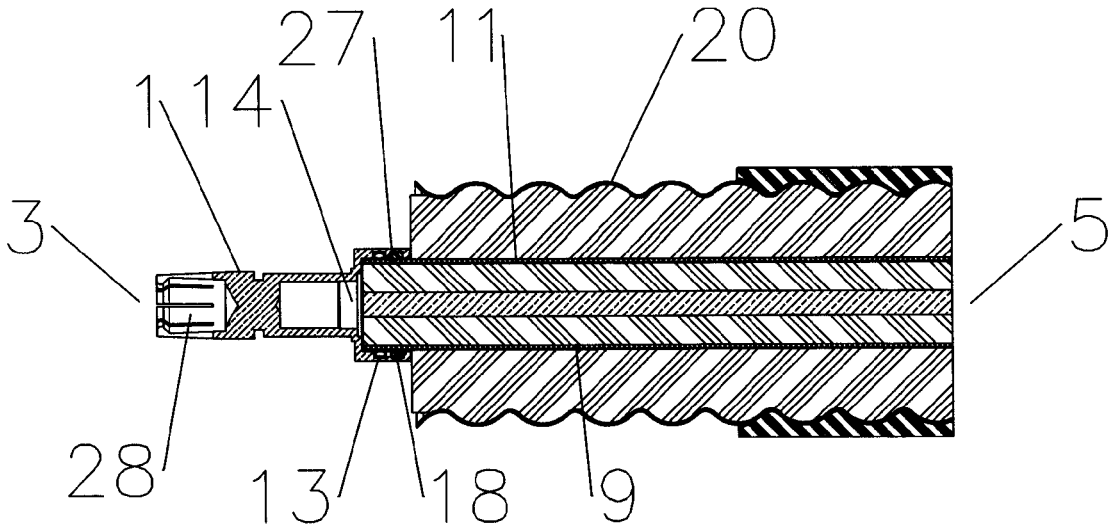
FIG. 7 is a schematic cut-away side view of an inner contact coupled to the inner conductor of a coaxial cable.
Figure 8:
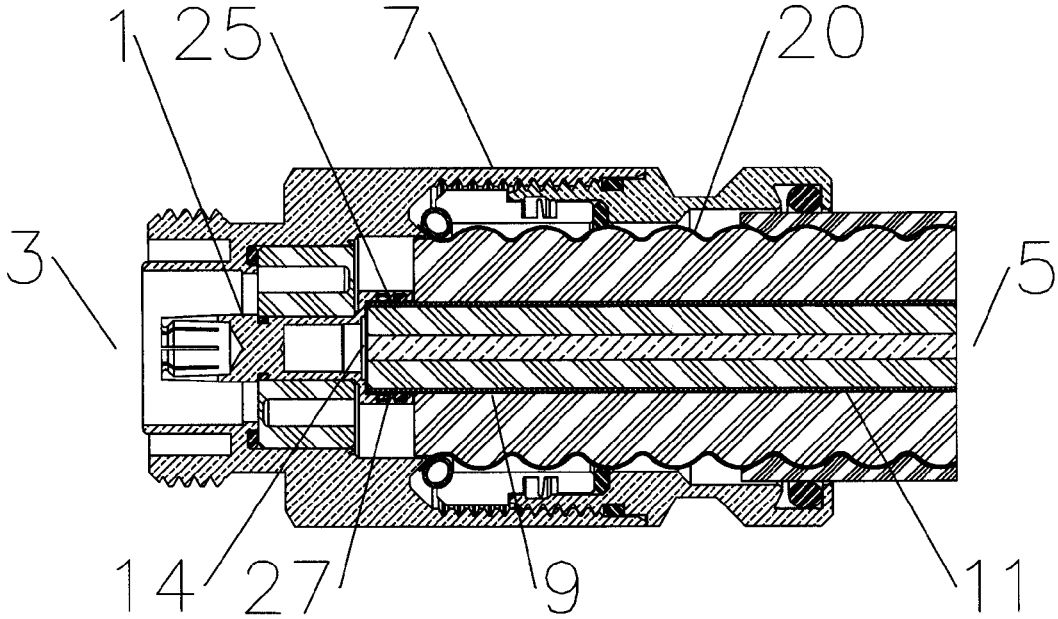
FIG. 8 is a schematic cut-away isometric side view of a connector assembly including an inner contact according to the invention, mounted upon a coaxial cable.
Figure 9A:
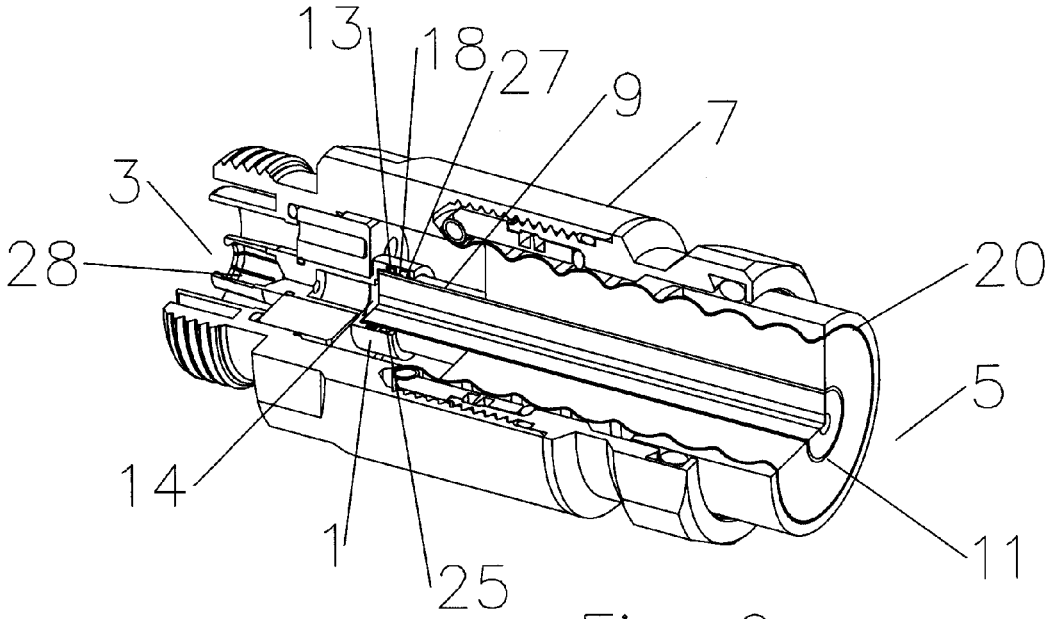
FIG. 9*a* is a schematic 45 degree cut-away isometric side view of FIG. 8.
Figure 9B:
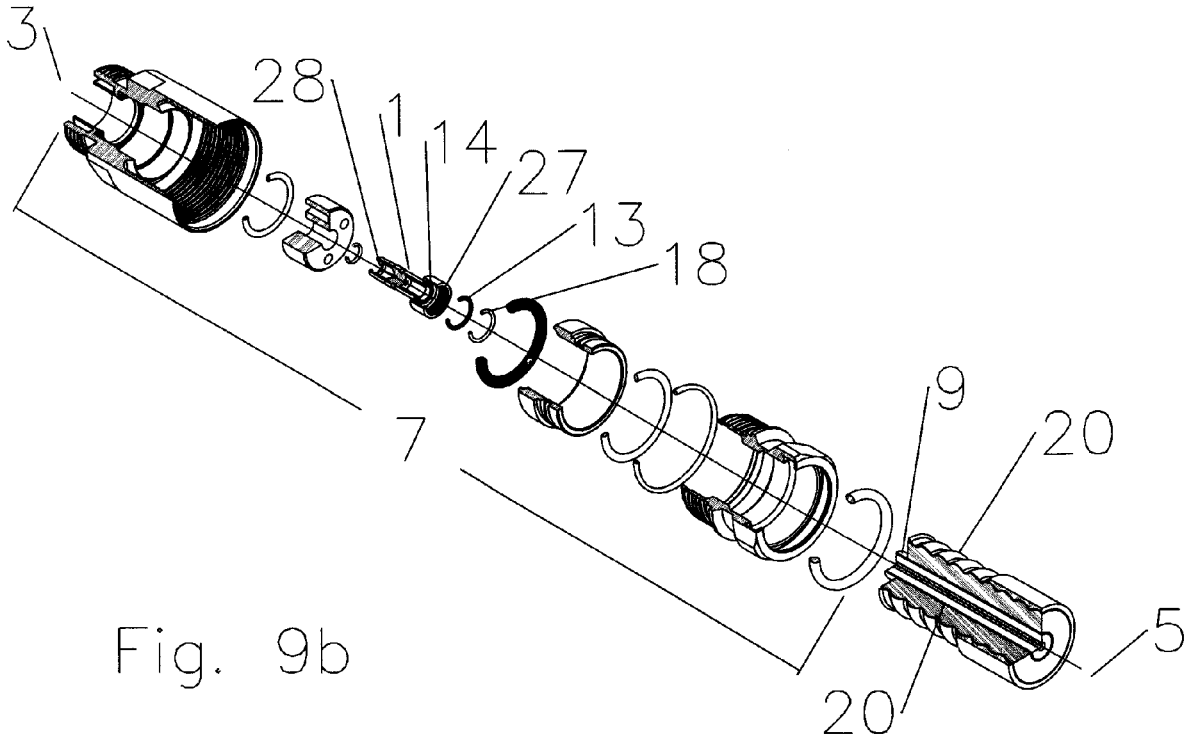
FIG. 9*b* is an exploded schematic 45 degree cut-away isometric side view of FIG. 8.
Figure 10:
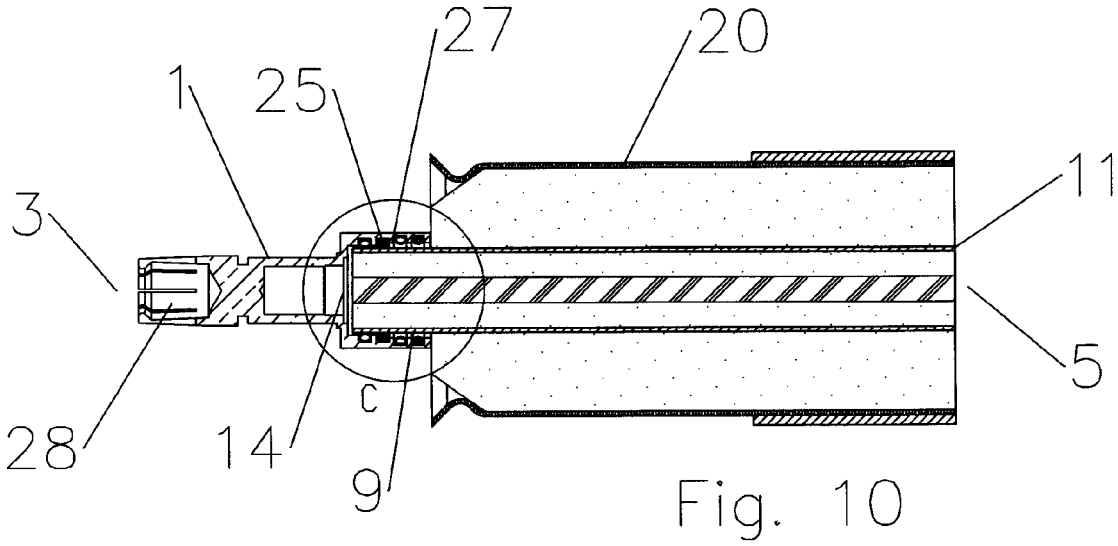
FIG. 10 is schematic cut-away side view of an alternative embodiment inner contact coupled to the inner contact of a coaxial cable.
Figure 11:
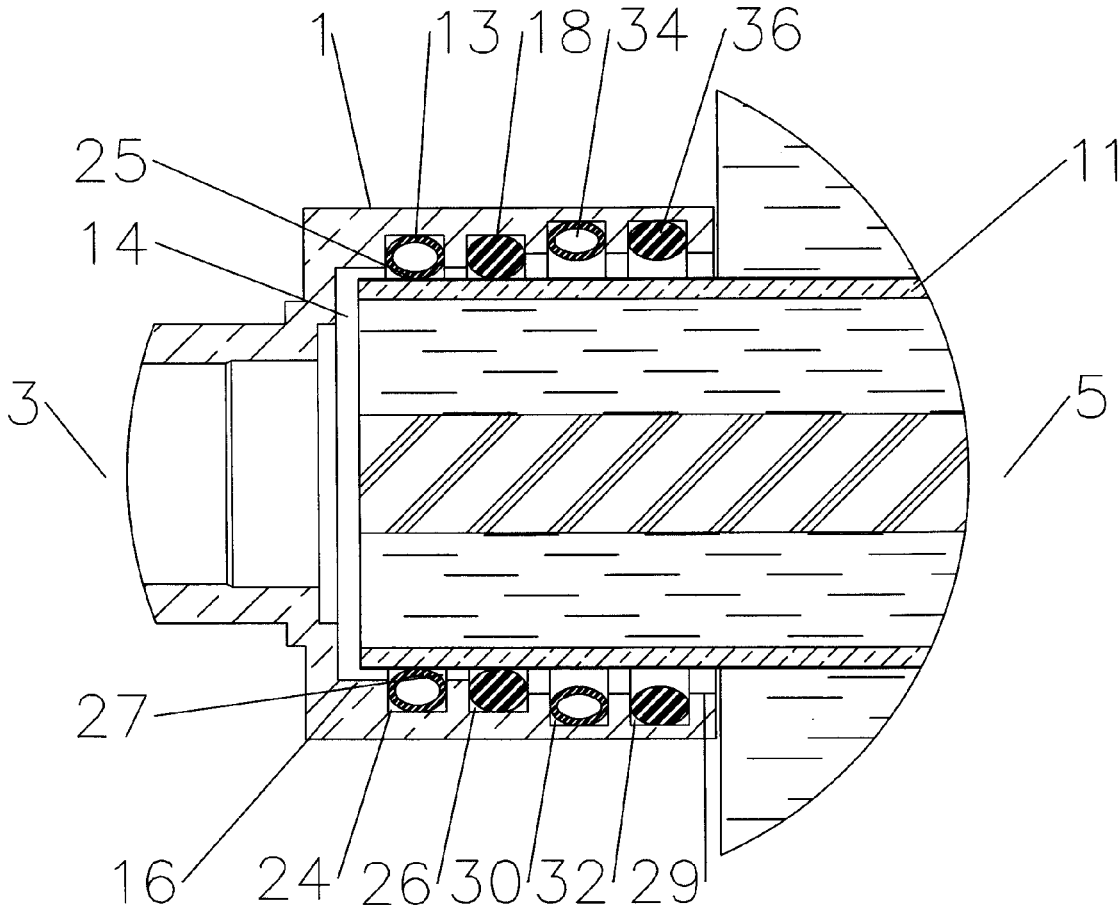
FIG. 11 is a close up view of area C of FIG. 10.
Figure 12:
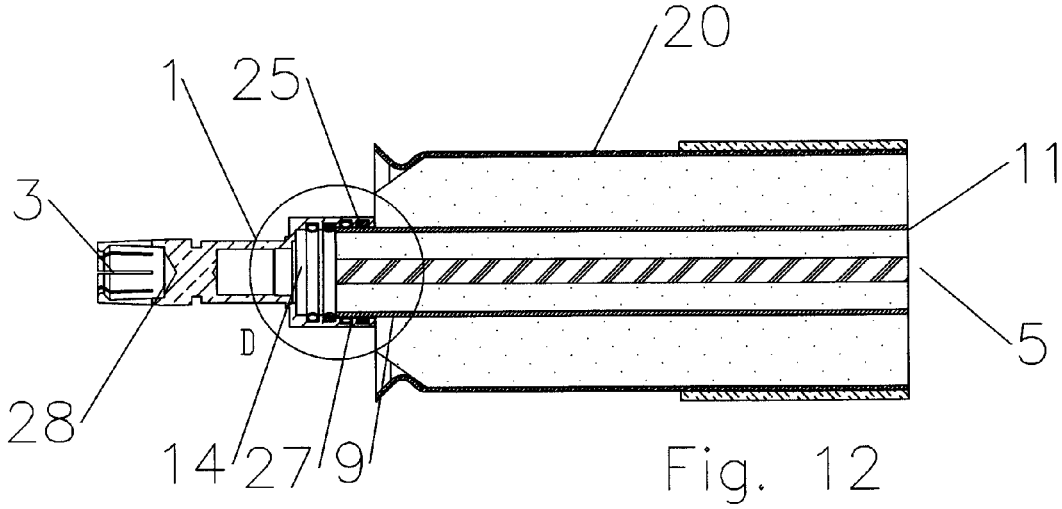
FIG. 12 is schematic cut-away side view of an alternative embodiment inner contact coupled to the inner contact of a coaxial cable as shown in FIG. 10, wherein the inner conductor has an increased diameter.
Figure 13:
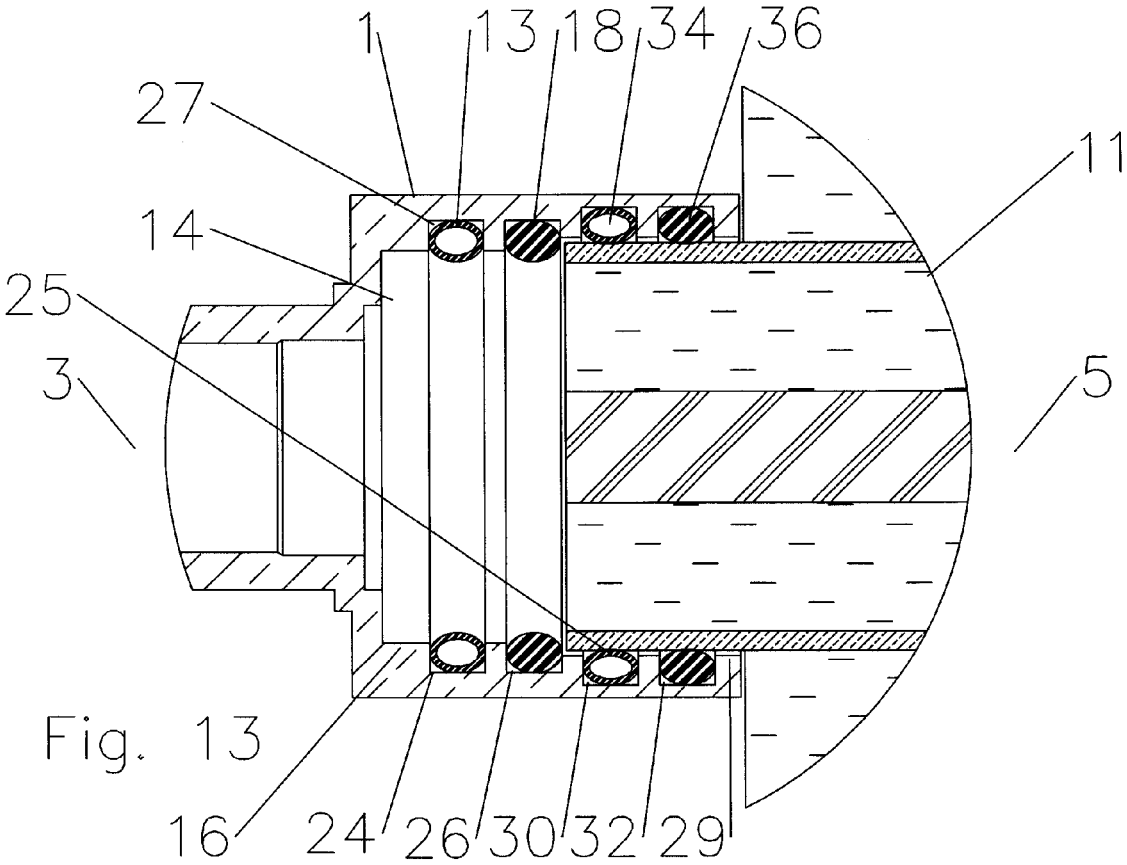
FIG. 13 is a close-up view of area D of FIG. 12.

As shown in FIG. 1, a first embodiment of a coaxial cable connector inner contact 1 with an interface end 3 and a cable end 5 (end designations along the inner contact longitudinal axis that are hereinafter similarly applied to individual elements of the inner contact 1 and associated connector assembly 7) attaches to the inner conductor 11 via a first spring contact 13 retained in the first sidewall section 16 of an inner conductor socket 14 open to the cable end 5. The first spring contact 13 is dimensioned to engage the outer diameter surface 9 of the inner conductor 11 to form a secure electrical interconnection between the inner contact 1 and the inner conductor 11 (FIG. 7).

The first spring contact 13 may be configured in a wide range of alternative configurations. For example, as shown in FIG. 1, the first spring contact 13 may also be formed as at least one spring coil(s) seated within, for example, a first inner diameter groove 24 of the first sidewall section 16.

Figure 2:
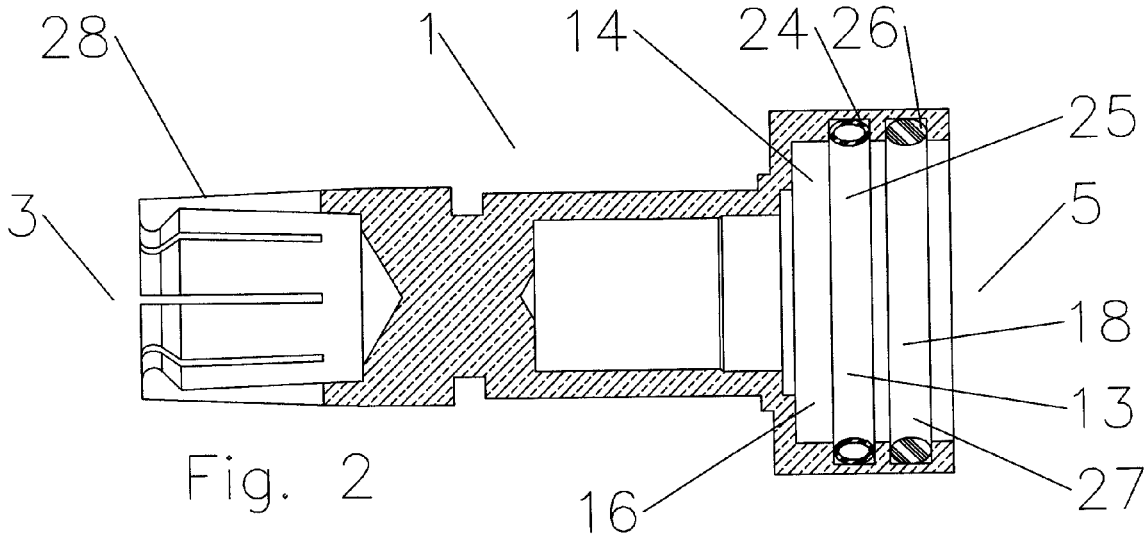
FIG. 2 is a schematic cut-away side view of a second exemplary inner conductor contact.
Figure 3:
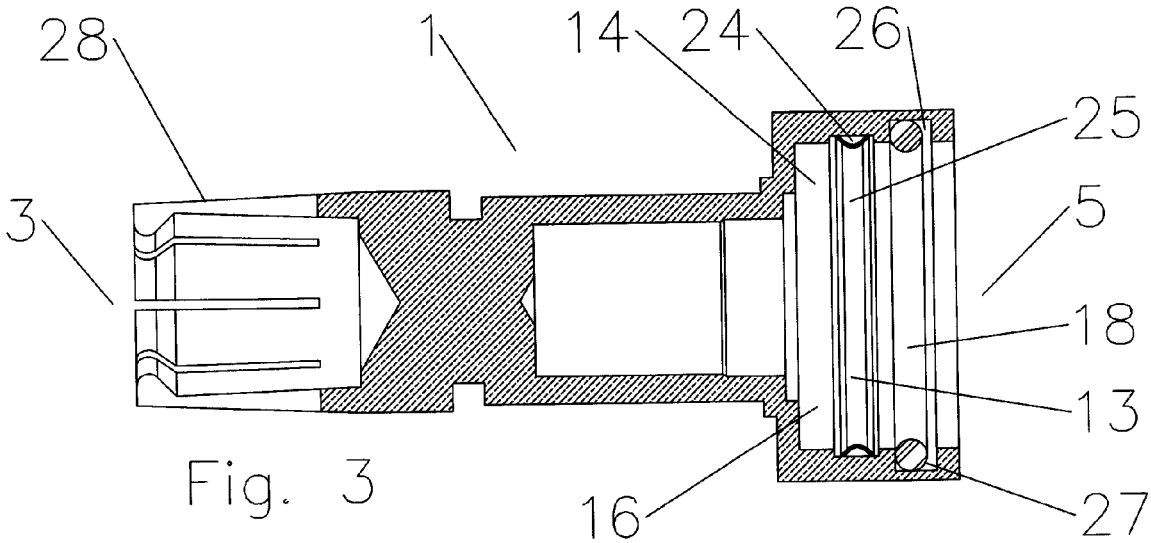
FIG. 3 is a schematic cut-away side view of a third exemplary inner conductor contact.

Alternative configurations for the first spring contact 13 may include, for example, a tubular ring (FIG. 2), and a generally u-shaped spring (FIG. 3), for example, wherein distal ends of the u-shaped spring are seated in the first diameter groove 24 and a center portion extends from the first sidewall section 16 to contact the outer diameter surface 9.

Figure 4:
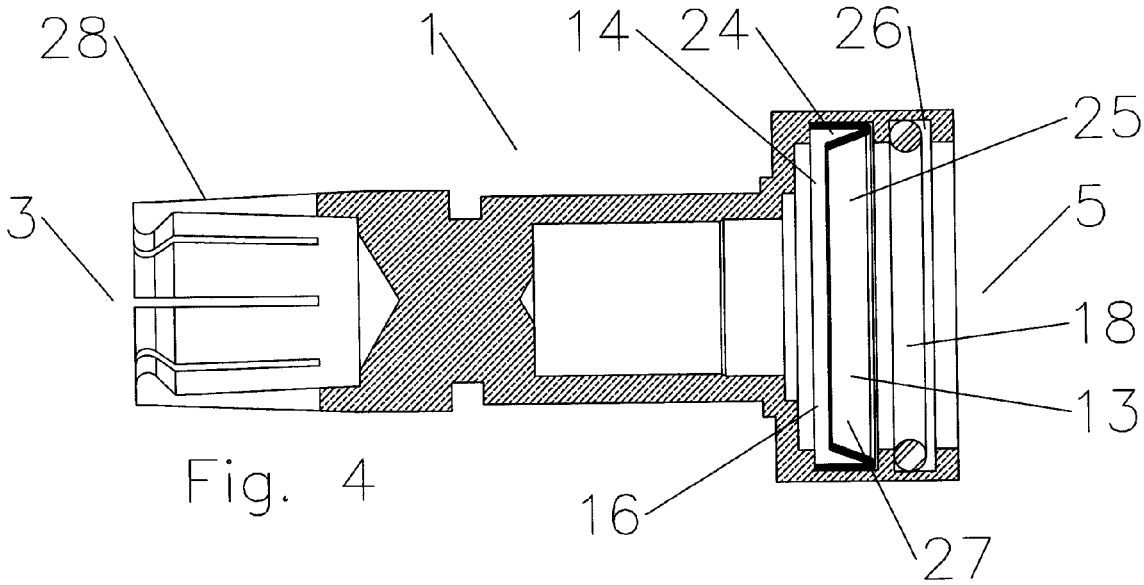
FIG. 4 is a schematic cut-away side view of a fourth exemplary inner conductor contact.
Figure 5:
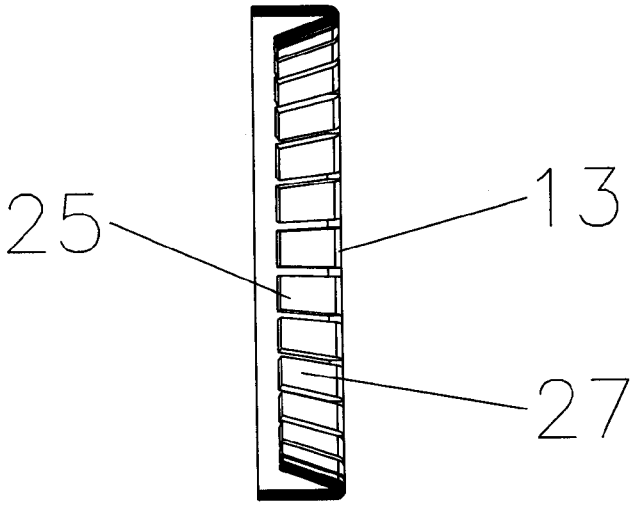
FIG. 5 is a schematic cut-away side view of an alternative embodiment spring contact.
Figure 6:
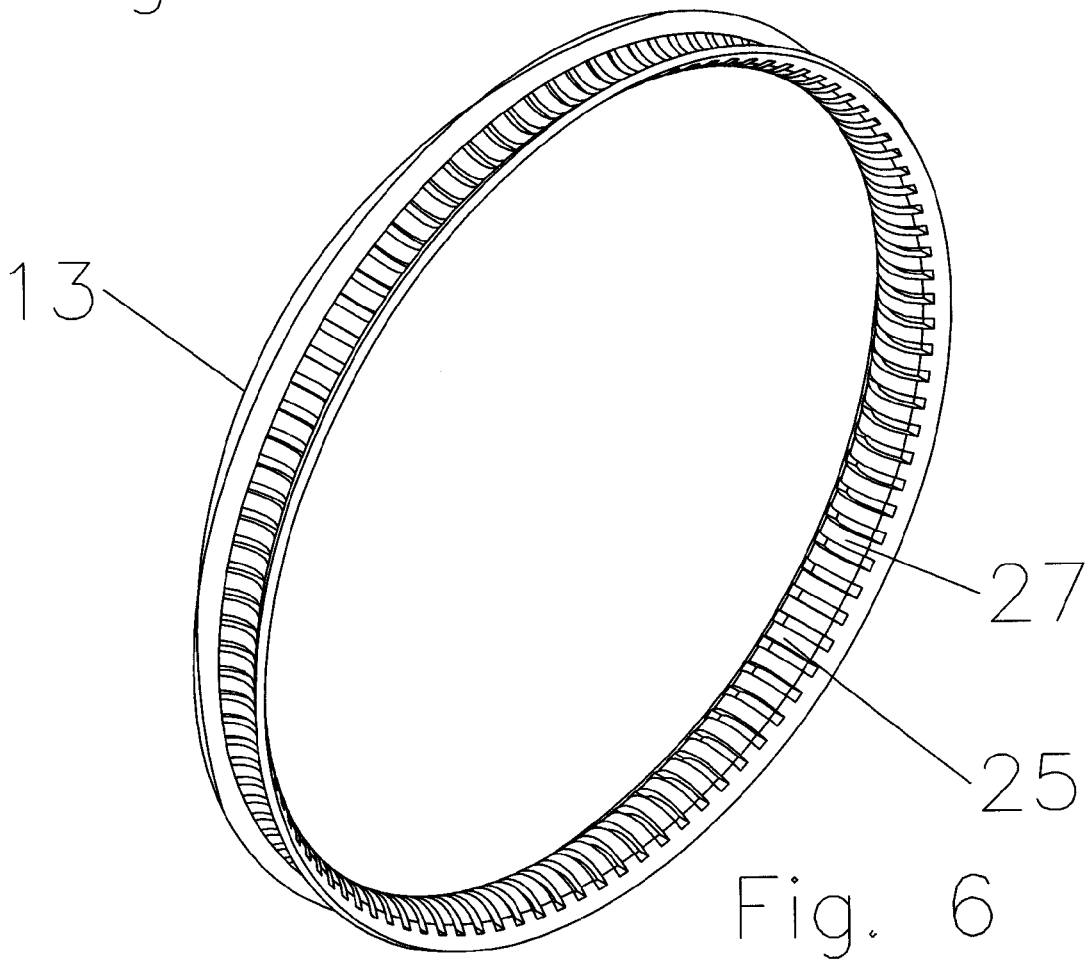
FIG. 6 is a schematic isometric view of an alternative embodiment spring contact.

Similarly, the first spring contact 13 may be a side mounted v-shaped spring (FIG. 4), for example wherein one side of the spring is coaxial to a longitudinal axis of the inner contact 1 and the other side projects from the first sidewall section at an angle towards the outer diameter surface 9. Further, the u-shaped and v-shaped spring(s) may be provided with a plurality of slot(s) proximate the interconnection surface 25, for example as shown in FIGS. 5 and 6, to create a plurality of individual contact elements carried by the respective first spring contact 13 structure. Each of the first spring contact 13 configurations may be either a contiguous ring, or c-shaped for ease of insertion into the first inner diameter groove 24.

Inner contact 1 to inner conductor 11 electrical interconnection area environmental sealing is provided via an first inward projecting seal 18 retained, for example, in a second inner diameter groove 26 of the first sidewall section 16, located at a cable end 5 side of the first inner diameter groove 24. The first inward projecting seal 18 may be formed as a separate gasket such as an o-ring or alternatively molded in place upon the second inner diameter groove 26 from a polymer with desired elasticity, oxidation and temperature characteristics.

In addition to seal design to prevent aluminum oxidation and/or corrosion, an inner contact 1 according to the invention may also include a surface sealant 27 (notation 27 in the various figures indicating several possible general surface sealant 27 application area(s), as the surface sealant 27 may be applied in coating thicknesses that are too thin to graphically represent in the various figures) such as an oxidation and/or corrosion inhibitor coating or grease. An example of suitable surface sealant(s) is the family of Dostex™ oxide inhibitors available from Dossert Corporation of Waterbury, Conn., US.

The surface sealant 27 may be provided pre-applied, for example, to the first and/or second inward projecting seal(s) 18, 36 the first and/or second inner diameter groove(s) 25, 26 and/or to the inner conductor socket 14. Alternatively, the dielectric grease may be applied by the user, for example, to the inner conductor 11 and or applied to the inner conductor socket 14, during connector installation.

Where the surface sealant 27 is applied, displacement of the first inward projecting seal 18 into/against the second inner diameter groove 26 as the inner conductor 11 is moved towards the inner contact 1 will spread a coating of the surface sealant 27 upon the inner conductor 11. When the inner contact 1 couples with the surface sealant 27 coated inner conductor 11, the mechanical force of the inner contact 1 will displace the surface sealant 27 from the immediate area of the electrical interconnection, sealing the electrical interconnection from exposure to the atmosphere and/or any moisture that may be present.

The inner conductor interface 28 at interface end 3 of the inner contact 1 is demonstrated in FIGS. 1-4 as a spring basket 15, according to the connector industry standard 7/16 DIN female connector interface. Alternatively, the inner conductor interface 28 may be any desired configuration and/or interconnection surface according to any desired standard or proprietary coaxial connector interface, including for example, a pin, socket or threaded connection surface to which a further interface element may be attached.

FIG. 7 demonstrates a typical embodiment of the inner contact 1 upon the coaxial cable. FIGS. **8-9*b* demonstrate incorporation of the inner contact 1 within a typical coaxial connector assembly 7. The connector assembly 7 configuration is generally dependent upon the outer conductor 20** configuration (smooth wall, annular corrugated, helical corrugated, etc.) and or desired connection interface of which a wide range of configurations are well known to one skilled in the art and as such are not further described herein.

To improve compatibility and/or reduce the total number of connector assembly configurations required, a single inner contact 1 may be configured for use with coaxial cables having inner conductors with different diameters. As shown for example in FIGS. 10-13, the inner conductor socket 14 may be formed with a second sidewall section 29 having a larger diameter than the first side wall section 16. A third inner diameter groove 30 and fourth inner diameter groove 32 are fitted with a corresponding second spring contact 34 and second inward projecting seal 36. Thereby, inner conductor (s) 11 of two different diameters may alternatively be received and secure electrical interconnections made, within the inner conductor socket 14 of a single inner contact 1. Surface sealant 27, as described herein above, may be similarly applied to these additional structures, also.

One skilled in the art will appreciate that the present invention may be easily integrated with existing coaxial connector configurations with a minimum of engineering rework and or tooling modification. Depending, for example, upon the desired operating frequencies, the required modifications may be limited to the exchange of a conventional inner contact configuration with an inner contact according to the invention.

An inner contact according to the invention provides an improved environmental seal located proximate the electrical connection between the inner conductor 11 and the inner contact 1 thus reducing opportunities for connector failure due to corrosion and or oxidation inherent in aluminum alloys when mechanically coupled to dissimilar metals. The inner contact 1 according to the invention is especially suited for use in electrical connectors for a coaxial cable with an aluminum inner conductor 11 having a copper or other metal coating about the outer diameter surface 9. Because the exposed end of the inner conductor and the metal coating edge exposed by cable end preparation for connector attachment are protected from moisture and or air exposure, opportunities for accelerated corrosion of the exposed aluminum and or related delamination of the metal coating are reduced, especially when a dielectric grease is applied to the inner conductor socket 14 prior to insertion of the inner conductor 11, to further exclude air or moisture from the electrical interconnection area.

Table of Parts

| | |
|---|---|
| 1 | inner contact |
| 3 | interface end |
| 5 | cable end |
| 7 | connector assembly |
| 9 | outer diameter surface |
| 11 | inner conductor |
| 13 | first spring contact |
| 14 | inner conductor socket |
| 16 | first sidewall section |
| 18 | first inward projecting seal |
| 20 | outer conductor |
| 24 | first inner diameter groove |
| 25 | interconnection surface |
| 26 | second inner diameter groove |
| 27 | surface sealant |
| 28 | inner conductor interface |
| 29 | second side wall section |
| 30 | third inner diameter groove |
| 32 | fourth inner diameter groove |
| 34 | second spring contact |
| 36 | second inward projecting seal |

Where in the foregoing description reference has been made to ratios, integers or components having known equivalents then such equivalents are herein incorporated as if individually set fourth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. A coaxial cable connector inner contact with an interface end and a cable end for coupling with the inner conductor of a coaxial cable, the inner conductor having an outer diameter surface, comprising:

an inner conductor interface at the interface end;

an inner conductor socket open to the cable end;

a first inner diameter groove in a first sidewall section of the socket;

a second inner diameter groove in the first sidewall section proximate the cable end;

a first spring contact, dimensioned to engage the outer diameter surface, seated in the first inner diameter groove;

a first inward projecting seal, dimensioned to seal against the outer diameter surface, seated in the second inner diameter groove.

2. The inner contact of claim 1, wherein the first spring contact is a spring coil.

3. The inner contact of claim 1, wherein the first spring contact is a tubular ring.

4. The inner contact of claim 1, wherein the first spring contact is a generally u-shaped spring.

5. The inner contact of claim 1, wherein the first spring contact is a v-shaped spring.

6. The inner contact of claim 1, wherein the first spring contact has a plurality of slots formed in an interconnection surface between the first spring contact and the outer diameter surface.

7. The inner contact of claim 1, wherein the first spring contact is c-shaped.

8. The inner contact of claim 1, further including a surface sealant.

9. The inner contact of claim 8, wherein the surface sealant is on the first inward projecting seal.

10. The inner contact of claim 8, wherein the surface sealant is in the inner conductor socket.

11. The inner contact of claim 8, wherein the surface sealant is on an interconnection surface between the first spring contact and the outer diameter surface.

12. The inner contact of claim 1, further including a second sidewall section of the inner conductor socket having a larger inner diameter than the first sidewall section;

a third inner groove and a fourth inner groove in the second sidewall section;

a second first spring contact seated in the third inner groove; and a second first inward projecting seal seated in the fourth inner groove.

13. The inner contact of claim 12, further including a surface sealant proximate an interconnection surface.

14. A method for coupling a coaxial cable connector inner contact with the inner conductor of a coaxial cable, the inner conductor having an outer diameter surface, comprising:

inserting the inner conductor into a socket of the inner contact, past a first inward projecting seal seated in a second inner diameter groove of a first sidewall section of the socket, into contact with a first spring contact seated within a first inner diameter groove of the first sidewall section.

15. The method of claim 14, further including the step of applying a surface sealant to the inner conductor before inserting the inner conductor into the socket.

16. The method of claim 14, further including the step of applying a surface sealant to the socket before inserting the inner conductor into the socket.

17. The method of claim 14, wherein a surface sealant within the socket surrounds an interconnection area between the first spring contact and an outer diameter surface of the inner conductor.

18. A coaxial cable connector inner contact with an interface end and a cable end for coupling with the inner conductor of a coaxial cable, the inner conductor having an outer diameter surface, comprising:

an inner conductor interface at the interface end;

an inner conductor socket open to the cable end;

a first inner diameter groove in a first sidewall section of the socket;

a second inner diameter groove in the first sidewall section proximate the cable end;

a spring coil, dimensioned to engage the outer diameter surface, seated in the first inner diameter groove;

an o-ring, dimensioned to seal against the outer diameter surface, seated in the second inner diameter groove;

the o-ring coated with a surface sealant.

* * * * *